US006407048B1

(12) United States Patent
Grippaudo et al.

(10) Patent No.: US 6,407,048 B1
(45) Date of Patent: Jun. 18, 2002

(54) PROCESS FOR CLEANING CARPETS COMPRISING POLYVINYL PYRIDINE-N-OXIDE

(75) Inventors: Gabriella Grippaudo; Carlo Ricci, both of Rome; Luca Sarcinelli, Palermo, all of (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/647,972

(22) PCT Filed: Apr. 7, 1999

(86) PCT No.: PCT/IB99/00600

§ 371 (c)(1),
(2), (4) Date: Oct. 6, 2000

(87) PCT Pub. No.: WO99/53007

PCT Pub. Date: Oct. 21, 1999

(30) Foreign Application Priority Data

| | | |
|---|---|---|
| Apr. 8, 1998 | (EP) | 98870075 |
| Apr. 8, 1998 | (EP) | 98870076 |
| Oct. 30, 1998 | (EP) | 98870231 |

(51) Int. Cl.[7] ..... C11D 17/00

(52) U.S. Cl. ..... 510/278; 510/281; 510/480; 510/499; 510/528; 134/40

(58) Field of Search ..... 134/40; 510/278, 510/279, 281, 302, 367, 370, 375, 499, 505, 480, 517, 528

(56) References Cited

U.S. PATENT DOCUMENTS 5,364,551 A 11/1994 Bona et al.

FOREIGN PATENT DOCUMENTS

| | | |
|---|---|---|
| EP | 794244 A1 | 9/1997 |
| GB | 1397475 | 6/1975 |
| GB | 2315783 | 2/1998 |
| WO | WO95/34631 | 12/1995 |

*Primary Examiner*—Necholus Ogden
(74) *Attorney, Agent, or Firm*—Jeffrey V. Bamber; Jason C. Camp

(57) ABSTRACT

The present invention relates to a process of cleaning a carpet with a liquid composition comprising an anti-resoiling agent, said process comprising the steps of applying said composition to the surface of the carpet and leaving said composition to dry onto the carpet. The carpet cleaning composition according to the present invention provides carpet cleaning and/or carpet anti-resoiling henefits. The preferred anti-resoiling agent is poly(4-vinylpyridine-N-oxide).

1 Claim, No Drawings

PROCESS FOR CLEANING CARPETS COMPRISING POLYVINYL PYRIDINE-N-OXIDE

TECHNICAL FIELD

The present invention relates to a process of cleaning carpets using a liquid composition. More particularly, the present invention relates to a process of cleaning carpets whereby good carpet cleaning performance and good carpet anti-resoiling performance is achieved.

BACKGROUND OF THE INVENTION

Carpets produced from synthetic or natural fibers and mixtures thereof are commonly used in residential and commercial applications as a floor covering. Various types of fibers can be used in making carpets such as polyamide fibers, polyester fibers as well as wool, cotton or even silk in the case of rugs.

However, carpets irrespective of whether they are made from natural or synthetic fibers are all prone to soiling and staining when contacted with many household items. Foods, grease, oils, beverages in particular such as coffee, tea and soft drinks especially those containing acidic dyes can cause unsightly, often dark stains on carpets. Also fibers may become soiled as a result of dirt particles, clay, dust, i.e., particulate soils in general, coming into contact with and adhering to the fibers of the carpet. These latter soils often appear in the form of a diffuse layer of soils rather than in the form of spots and tend to accumulate particularly in the so called "high traffic areas" such as near doors as a result of intensive use of the carpets in such areas.

Compositions for the cleaning of carpets are already known in the art. For example carpet cleaning compositions based on surfactants and polyvinylpyrrolidone as disclosed in EP-A-822 249.

However, such compositions are not fully satisfactory from a consumer viewpoint. In particular, the anti-resoiling properties imparted to the carpets treated therewith. Indeed. consumers are looking for liquid carpet cleaning compositions that would render a carpet first treated therewith less prone to soil and thus facilitate next-time cleaning operation.

Thus, the object of the present invention is to provide a process for cleaning a carpet with a liquid carpet cleaning composition that will impart anti-resoiling properties to a carpet treated therewith.

Furthermore, it is an object of the present invention to provide a process of cleaning a carpet which provides excellent overall cleaning performance on various types of stains including particulate stains, greasy stains, bleachable stains and/or enzymatic stains.

It has now been found that the above objects can be met by a process of cleaning a carpet with a liquid composition comprising an anti-resoiling agent.

An advantage of the process of cleaning carpets according to the present invention is that of being easy and fast while providing excellent overall cleaning performance. More advantageously, the process of cleaning carpets according to the present invention provides excellent cleaning performance, when both used to clean the whole carpet or localized carpet stains. In addition to this, this process does not leave tacky residue on carpets.

Advantageously, excellent cleaning performance is obtained on different types of stains and soils, including enzymatic stains as well as particulate stains and/or greasy stains, especially in the so called "high traffic areas".

A further advantage of the present invention is that the process of cleaning carpets herein is applicable to all carpet types, especially delicate natural fibers, and are also safe to all carpet dye types. particularly sensitive natural dyes used therein. The present invention is also suitable to be used to clean upholstery and car seats covering.

Yet another advantage of the process of cleaning carpets and of the compositions of the present invention is that they may be applied directly on the carpet without causing damage to the carpet.

BACKGROUND ART

The following documents are representative of the prior art available on carpet cleaning compositions.

EP-A-751 213 discloses a carpet cleaning composition comprising salicylic acid, and a compound selected from the group consisting of amine oxides, soil suspending polycarboxylate or polyamine polymers, hydroxy-pyridine N-oxides, chelating agents and mixtures thereof.

EP-A-822 249 discloses carpet cleaner compositions comprising a polyvinylpyrrolidone polymer.

None of these documents discloses a process of cleaning a carpet with a composition comprising an anti-resoiling agent.

SUMMARY OF THE INVENTION

The present invention encompasses a process of cleaning a carpet with a liquid composition comprising an anti-resoiling agent, said process comprising the steps of applying said composition to the surface of the carpet and leaving said composition to dry onto the carpet.

In a preferred embodiment said composition further comprises a peroxygen bleach.

In another preferred embodiment said anti-resoiling agent is a anti-resoiling polymer, preferably a polyamine N-oxide polymer, more preferably a poly vinyl pyridine-N-oxide polymer.

In another preferred embodiment said composition further comprises a surfactant, preferably an anionic surfactant or a zwitterionic surfactant or a mixture thereof, most preferably a sarcosinate surfactant.

The present invention also encompasses the use of a polyamine N-oxide polymer as an anti-resoiling agent in a carpet cleaning composition to clean carpets whereby said carpet cleaning composition provides carpet cleaning and/or carpet anti-resoiling benefits.

DETAILED DESCRIPTION OF THE INVENTION

Process of Cleaning a Carpet

The present invention encompasses a process of cleaning a carpet with a liquid composition comprising an anti-resoiling agent, said process comprising the steps of applying said composition to the surface of the carpet and leaving said composition to dry onto the carpet.

Preferably said process of cleaning a carpet further comprises the step of removing said composition.

Preferably the composition is applied onto the carpet in the form of a spray of droplets having a particle size distribution with a mean diameter D(v,0.9) of less than 1500 microns, preferably less than 1000 microns, more preferably of less than 750 microns, even more preferably less than 500 microns. and most preferably from 350 microns to 10 microns.

By "mean diameter D(v,0.9) of less than 1500 microns" for a droplet size distribution it is meant that 90% of the spray of droplets dispensed (expressed in volume unit) has a droplet diameter of less than 1500 microns. For instance, a D(v,0.9) of less than 1500 microns indicates that 90% of the total sprayed volume is dispensed with droplets whose diameter is less than 1500 microns.

The particle size distribution of a spray of droplets can be determined by following the procedure detailed herebelow.

A suitable test equipment is the Malvern Mastersizer S LongBed® with 1000 mm lens and a maximum particle size range of 3475 microns. The Malvern Mastersizer S LongBed® provides 21 cm opening (between lenses) to accommodate spray flow. In all readings at the Malvern®, the lens surface must remain free of spray contamination. In the present setup procedure, the distance from nozzle to laser was fixed at 8 cm, this to minimize lens contamination. At 8 cm distance, the spray was directed to the laser beam to place the laser center to the spray cone. At least three readings have to be made for each composition sprayed to determine the particle size distribution of the spray of droplets. The sprayer used in the test according to the present invention was an electrically operated sprayer. With the battery driven system a "Full charge" test was held consistent by holding the spray head to 3.9 voltage direct current (vdc) from an external power supply, this to insure a consistent spray force. A reference sprayer used herein is a hand trigger operated sprayer. Hand trigger systems have to be tested against repeatability with three different persons. These persons chosen for their varied ability to actuate the trigger against force: Small female, female with strong finger strength. and medium male.

Any container adapted to deliver a spray of droplets as defined herein is suitable for use herein. Several modifications can be made to the conventional, single aperture, spray head to ensure that a spray of such droplets as required herein is formed. Suitable containers to be used herein (also called "spray dispensers") share the common feature of having at least one aperture or a plurality of apertures also called "dispensing openings" through which the composition is dispensed so as to produce the spray of droplets as defined herein.

These spray dispensers may be manually or electrically operated. Typical manually operated spray dispensers include pump operated ones or trigger operated ones. Indeed, in such a container with a spray dispenser head the composition contained in the container is directed through the spray dispenser head via energy communicated to a pumping mechanism by the user as said user activates said pumping mechanism or to an electrically driven pump. Preferred herein is to use a container wherein the means for delivering the composition comprises an electrically driven pump and a spray arm being either extended or extendible and having at least one dispensing opening so that in operation, the composition is pumped by electrically driven pump from the container, through the spray arm to the dispensing opening from which it is dispensed. It is preferred that the spray arm communicates with the container by means of a flexible connector. The spray arm may have one nozzle or multiple nozzles located along its length. The spray arm makes it easier to control where the composition is sprayed. The electrically driven pump may be, for example, a gear pump, an impeller pump, a piston pump, a screw pump, a peristaltic pump, a diaphragm pump, or any other miniature pump. In a highly preferred embodiment of the electrically driven pump for use herein the pump is a gear pump with a typical speed between 6000 rpm and 12000 rpm. The electrically driven pump is driven by a means such as an electric motor which typically produces a torque between 1 and 20 mN.m. The electric motor must in turn be provided with a power source. The power source may be either mains electricity (optionally via transformer), or it may be a throw-away battery or rechargeable battery. The spray arm may be rigidly extended. However such a spray arm can be difficult to store, and the spray arm is preferably extensible either by means of telescopic or foldable configuration The amount of the compositions for the cleaning of carpets according to the present invention applied will depend on the severity of the stain or soil. In the case of stubborn stains more than one application may be required to ensure complete removal of the stain.

The area to be cleaned by applying the compositions according to the present invention may be of any size. Indeed. a complete section or more preferably the whole carpet may be treated with the composition for the cleaning of carpets according to the present invention.

In a process of cleaning a carpet according to the present invention the step of applying a composition onto the carpets as described herein before, does not need to be followed by a step where manual action is required other than the final optional removing step. Indeed the compositions herein allow excellent cleaning performance without requiring any manual action like rubbing and/or brushing. An advantage of the present invention is that the cleaning action of the present compositions commences as soon as said compositions are applied onto said carpet.

Typically, the composition is left to dry on the carpet for less than 2 hour, preferably less than 1 hour, more preferably less than 40 minutes, even more preferably from 1 to 30 minutes and most preferably from 1 to 20 minutes.

By "dry" it is meant herein the stage where at least 40%, preferably at least 60% of the initial amount of composition dispensed onto the carpet is lost due to evaporation.

Indeed, said composition is left to dry until said composition which combined with dirt has been changed into dry residues. Preferably. said composition is then removed from the carpet. More preferably said composition is removed mechanically, even more preferably by vacuum cleaning. This may be carried out with the help of any commercially available vacuum cleaners like for instance a standard Hoover® 1300W vacuuming machine.

According to the present invention the compositions herein may be used for the removal of stains and soils from carpets, upholstery or car seats covering as well as of odors. In addition the compositions according to the present invention may be used to hygienise, disinfect and/or exterminate microinsects from carpets, upholstery or car seats covering.

The Composition

The compositions of the present invention are formulated as liquid compositions. Preferred compositions herein are aqueous compositions and therefore, preferably comprise water more preferably in an amount of from 60% to 98%, even more preferably of from 80% to 97% and most preferably 85% to 97% by weight of the total composition.

The pH of the liquid compositions according to the present invention may typically be from 1 to 14. In a preferred embodiment, the recommended pH range is from 1 to 10, preferably between pH 2 and 8, more preferably between pH 3 and 7, even more preferably between pH 4.5 and 7 and most preferably between 3.5 and 6.5. Indeed, it has been surprisingly found that cleaning performance is further improved at these preferred pH ranges. Also these preferred pH ranges contribute to the stability of hydrogen peroxide, when present. Accordingly, the compositions herein may further comprise an acid or base to adjust pH as appropriate.

Preferred acids herein are organic or inorganic acids or mixtures thereof. Preferred organic acids are acetic acid, or citric acid or a mixture thereof. Preferred inorganic acids are sulfuric acid or phosphoric acid or a mixture thereof. A particularly preferred acid to be used herein is an inorganic acid and most preferred is sulfuric acid.

Typical levels of such acids, when present, are of from 0.01% to 1.0% by weight. preferably from 0.05% to 0.8% and more preferably from 0.1% to 0.5% by weight of the total composition.

The bases to be used herein can be organic or inorganic bases. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate and hydrogen carbonate.

Typical levels of such bases, when present, are of from 0.01% to 1.0% by weight, preferably from 0.05% to 0.8% and more preferably from 0.1% to 0.5% by weight of the total composition.

Anti-resoiling Agent

As an essential ingredient the compositions according to the present invention comprise an anti-resoiling agent.

Any anti-resoiling agent having the desired anti-resoiling properties may be used.

By "anti-resoiling properties" it is meant herein that the carpet, having been cleaned with a composition according to the present invention, is more effectively cleaned in a subsequent carpet cleaning operation (e.g., mechanical carpet cleaning, as vacuum cleaning. brushing and the like; or carpet cleaning by chemical means). Particularly. it is meant that less effort and/or less product needs to be applied to the carpet to achieve the same or even a better cleaning versus when the carpet is cleaned with a composition not containing an anti-resoiling agent.

Suitable anti-resoiling agents include anti-resoiling polymers.

Suitable anti-resoiling polymers include polyamine N-oxide polymers.

Suitable polyamine N-oxide polymers for use herein are according to the following formula $R—A_x—P$; containing at least one N-oxide group (N—O group);

wherein: P is a polymerizable unit to which an N—O group can be attached and/or the N—O group can form part of the polymerizable unit;

A is one of the following structures:

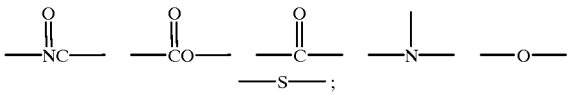

x is 0 or 1;

and R is an aliphatic, ethoxylated aliphatic, aromatic, heterocyclic or alicyclic group or any combination thereof to which the N—O group can be attached to R or the nitrogen of the N—O group is part of R.

By "N—O group" it is meant one of the following general structures

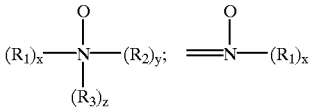

wherein $R_1$ $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups.

Any polymerizable unit P can be used as long as the amine oxide polymer formed is water-soluble and provides the carpet cleaning composition with carpet cleaning and/or carpet anti-resoiiing benefits. Preferred polymerizable unit P are vinyl, alkylenes, esters, ethers, amides, imides, acrylates and mixtures thereof. A more preferred polymerizable unit P is vinyl.

Preferred polyamine N-oxide polymers are those wherein R is a heterocyclic group such as pyridine, pyrrole, imidazole, or a derivative thereof, to which the nitrogen of the N—O group can be attached or the N—O group is part of these groups. Most preferred polyamine N-oxide polymers are those wherein R is a pyridine.

The polyamine N-oxide polymer can be obtained in almost any degree of polymerization. Typically, the average molecular weight is within the range of 1,000 to 100,000; more preferred 5,000 to 100,000; most preferred 5.000 to 25,000.

Suitable polyamine N-oxide polymer are polyvinyl pyridine-N-oxide polymers wherein the polymerizable unit P is vinyl. x=O; and R is pyridine wherein the nitrogen of the N—O group is part of.

Suitable poly vinyl pyridine-N-oxide polymers are commercially available from Hoechst under the trade name of Hoe S 4268®, and from Reilly Industries Inc. under the trade name of PVNO.

Another aspect of the present invention is the use of a polyamine N-oxide polymer as an anti-resoiling agent in a carpet cleaning composition to clean carpets whereby said carpet cleaning composition provides carpet cleaning and/or carpet anti-resoiling benefits.

Suitable anti-resoiling polymers also include soil suspending polycarboxylate polymers or a soil suspending polyamine polymers.

Any soil suspending polycarboxylate polymer known to those skilled in the art can be used according to the present invention such as homo- or co-polymeric polycarboxylic acids or their salts including polyacrylates and copolymers of maleic anhydride or/and acrylic acid and the like. Indeed, such soil suspending polycarboxylate polymers can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid. citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than 40% by weight.

Particularly suitable polymeric polycarboxylates to be used herein can be derived from acrylic acid. Such acrylic acid-based polymers which are useful herein are the water-soluble salts of polymerized acrylic acid. The average molecular weight of such polymers in the acid form preferably ranges from 2,000 to 10,000, more preferably from 4,000 to 7.000 and most preferably from 4,000 to 5.000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylicimaleic-based copolymers may also be used as a preferred soil suspending polycarboxylic polymer. Such materials include the water-soluble salts of copolymers of acrylic acid and maleic acid. The average molecular weight of such copolymers in the acid form preferably ranges from 2,000 to 100,000, more preferably from 5,000 to 75,000, most preferably from 7,000 to 65,000. The ratio of acrylate to maleate segments in such copolymers will generally range from 30:1 to 1:1, more preferably from 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982. Particularly preferred is a copolymer of maleic/acrylic acid with an average molecular weight of 70,000. Such copolymers are commercially available from BASF under the trade name SOKALAN® CP5.

Any soil suspending polyamine polymer known to those skilled in the art may also be used herein. Particularly suitable polyamine polymers for use herein are alkoxylated polyamines. Such materials can conveniently be represented as molecules of the empirical structures with repeating units

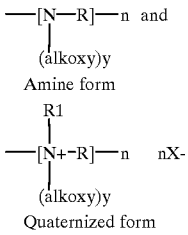

wherein R is a hydrocarbyl group, usually of 2–6 carbon atoms; $R_1$ may be a $C_1$–$C_{20}$ hydrocarbon; the alkoxy groups are ethoxy, propoxy, and the like, and y is 2–30, most preferably from 10–20; n is an integer of at least 2, preferably from 2–20, most preferably 3–5; and X— is an anion such as halide or methylsulfate, resulting from the quaternization reaction.

The most highly preferred polyamines for use herein are the so-called ethoxylated polyethylene amines, i.e., the polymerized reaction product of ethylene oxide with ethyleneimine, having the general formula

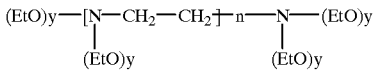

when y =2–30, preferably 15 and n is 1–30 preferably 4. Particularly preferred for use herein is an ethoxylated polyethylene amine, in particular ethoxylated tetraethylenepentamine, and quaternized ethoxylated hexamethylene diamine. Other suitable anti-resoiling polymers include those anti-resoiling polymers having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate: $C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic. whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 1 to about 200, although higher levels can be used, preferably from 3 to about 150, more preferably from 6 to about 100. Suitable oxy $C_4$–$C_6$ alkylene hydrophobe segments include. but are not limited to, end-caps of polymeric soil release agents such as $MO_3S(CH_2)_nOCH_2CH_2O$—, where M is sodium and n is an integer from 4–6, as disclosed in U.S. Pat. No. 4,721.580, issued Jan. 26, 1988 to Gosselink.

Anti-resoiling polymers useful in the present invention also include cellulosic derivatives such as hydroxyether cellulosic polymers, co-polymeric blocks of ethylene terephthalate or propylene terephthalate with polyethylene oxide or polypropylene oxide terephthalate, and the like. Such anti-resoiling polymers are commercially available and include hydroxyethers of cellulose such as METHOCEL (Dow). Cellulosic anti-resoiling polymers for use herein also include those selected from the group consisting of $C_1$–$C_4$ alkyl and $C_4$ hydroxyalkyl cellulose: see U.S. Pat. No. 4,000,093, issued Dec. 28, 1976 to Nicol, et al.

Anti-resoiling polymers characterised by poly(vinyl ester) hydrophobe segments include graft co-polymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available anti-resoiling polymers of this kind include the SOKALAN type of material, e.g., SOKALAN HP-22, available from BASF.

One type of preferred anti-resoiling polymers is a co-polymer having random blocks of ethylene terephthalate and polyethylene oxide (PEO) terephthalate. The molecular weight of this anti-resoiling polymers is in the range of from about 25,000 to about 55,000. See U.S. Pat. No. 3,959,230 to Hays, issued May 25, 1976 and U.S. Pat. No. 3,893,929 to Basadur issued Jul. 8. 1975.

Another preferred anti-resoiling polymers is a polyester with repeat units of ethylene terephthalate units which contains 10–15% by weight of ethylene terephthatate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4.702.857, issued Oct. 27. 1987 to Gosselink.

Another preferred anti-resoiling polymers agent is a sulfonated product of a substantially linear ester oligomer comprised of an oligomeric ester backbone of terephthaloyl and oxyalkyleneoxy repeat units and terminal moieties covalently attached to the backbone. These anti-resoiling polymers are fully described in U.S. Pat. No. 4,968,451, issued Nov. 6. 1990 to J. J. Scheibel and E. P. Gosselink. Other suitable anti-resoiling polymers include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink. Preferred anti-resoiling polymers also include the soil release agents of U.S. Pat. No. 4,877,896, issued Oct. 31, 1989 to Maldonado et al, which discloses anionic, especially sulfoaroyl. end-capped terephthalate esters.

Still another preferred anti-resoiling agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred anti-resoiling agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate.

Said anti-resoiling agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof. See U.S. Pat. No. 5,415,807, issued May 16, 1995, to Gosselink et al.

The liquid compositions may comprise from 0.01% to 10%, preferably from 0.01% to 5%, and more preferably from 0.05% to 2% by weight of the total composition of an anti-resoiling agent.

A preferred anti-resoiling agent is a anti-resoiling polymer. A more preferred anti-resoiling agent is a polyamine N-oxide polymer. An even more preferred anti-resoiling agent is a polyvinyl pyridine-N-oxide polymer. The most preferred anti-resoiling agent useful in the compositions herein is poly(4-vinylpyridine-N-oxide).

It has now been found that when anti-resoiling agents, preferably anti-resoiling polymers, more preferably the polyamine N-oxide polymers, as described herein are added into liquid compositions, a film, i.e., a layer of these agents, preferably polymers, is left on the carpet fibers treated with said composition. The film reduces adhesion of soils onto said carpet fibers treated with the composition according to the present invention and/or facilitate removal of soils subsequently deposited thereon. Thus, less effort (e.g., less vacuum cleaning and/or less chemical action) is required to remove the soils in the next cleaning operation ("carpet anti-resoiling performance/ benefit"), as compared to the cleaning of a similarly soiled carpet which has been first treated with the same composition but wherein an anti-resoiling agent is absent.

Furthermore, It has been found that the presence of an anti-resoiling agent, preferably an anti-resoiling polymer, more preferably a polyamine N-oxide polymer, in the compositions herein further contributes to the overall cleaning performance ("carpet cleaning benefit") of the compositions herein.

Indeed, it has been observed that the anti-resoiling agents, preferably anti-resoiling polymers, more preferably the polyamine N-oxide polymers, are capable of complexing or even encapsulating soil particles on a treated carpet and thereby, form solid and glassy residues with said soil particles upon drying of the composition as described herein. More particularly, more than 90%, preferably more than 95% of the residues left onto the carpet are solid and glassy. By 'glassy' it is meant that the residues are non-sticky, i.e., they do not stick to the carpet fibers and/or each other. This results in a process of cleaning carpets whereby the solid and glassy residues left onto the carpets are removed more easily as opposed to residues being sticky, and thus difficult to remove (e.g., by vacuum cleaning said carpets). The presence of the anti-resoiling agent, preferably the polyamine N-oxide polymer, reduces or even prevents the formation of tacky residues on the surface of the carpet upon drying, as compared to the same compositions but without the anti-resoiling agent, preferably the polyamine N-oxide polymer.

Additionally, by almost completely removing the residues the present invention reduces or even prevents soil re-deposition on the carpet.

The compositions employed in the process of cleaning carpets according to the present invention provide excellent cleaning performance on various types of soils including diffuse soils (e.g., particulate and/or greasy soils) that tend to accumulate in the so called "high traffic areas" but also in delivering good cleaning performance on other types of stains or soils, i.e. enzymatic stains like blood.

By "particulate stains" it is meant herein any soils or stains of particulate nature that can be found on any carpet, e.g. clay, dirt, dust. mud, concrete and the like.

By "greasy/oily stains" it is meant herein any soils or stains of greasy/oily nature that can be found on any carpet, e.g., make-up, lipstick, dirty motor oil and mineral oil, greasy food like mayonnaise and spaghetti sauce.

By "enzymatic stains" it is meant herein any soils or stains of enzymatic nature that can be found on any carpet, e.g., grass.

The cleaning performance of a given composition on a soiled carpet may be evaluated by the following test method. A liquid composition according to the present invention is first applied, preferably sprayed. onto the stained portion of a carpet, left to act thereon from 1 to 60 minutes, preferably 30 minutes, after which the carpet is vacuum cleaned. Typical soils used in this test may be grass, dirty motor oil, tea, coffee, dust and/or mayonnaise. The cleaning performance may be evaluated by visual grading.

Optional Ingredients

Peroxygen Bleach

As an optional but highly preferred ingredient the compositions according to the present invention may comprise a peroxygen bleach.

A preferred peroxygen bleach for use herein is hydrogen peroxide or a source thereof. As used herein a hydrogen peroxide source refers to any compound which produces perhydroxyl ions when said compound is in contact with water.

Suitable water-soluble sources of hydrogen peroxide for use herein include percarbonates, persilicate, persulphate such as monopersulfate, perborates, preformed peroxyacids, alkyl hydroperoxides, peroxides, aliphatic diacyl peroxides and mixtures thereof. Hydrogen peroxide is preferred to be used in the compositions according to the present invention.

Suitable preformed peroxyacids for use in the compositions herein include diperoxydodecandioic acid DPDA, magnesium perphthalatic acid, perlauric acid, perbenzoic acid, diperoxyazelaic acid and mixtures thereof.

Suitable hydroperoxides for use herein are tert-butyl hydroperoxide, cumyl hydroperoxide, 2,4,4-trimethylpentyl-2-hydroperoxide, di-isopropylbenzene-monohydroperoxide, tert-amyl hydroperoxide, 2,5-dimethyl-hexane-2.5-dihydroperoxide or mixtures thereof.

Suitable aliphatic diacyl peroxides for use herein are dilauroyl peroxide, didecanoyl peroxide, dimyristoyl peroxide or mixtures thereof.

Typically, the liquid compositions herein comprise from 0.01% to 20%, preferably from 0.5% to 10%, and more preferably from 1% to 7% by weight of the total composition of a peroxygen bleach, or mixtures thereof.

The presence of a peroxygen bleach in preferred compositions employed in the process of cleaning carpets according to the present invention contributes to the excellent cleaning and sanitizing performance on various types of soils including on spot stains like bleachable stains (e.g., coffee, beverage, food) of the compositions of the present invention.

By "bleachable stains" it is meant herein any soils or stains containing ingredients sensitive to bleach that can be found on any carpet, e.g., coffee or tea.

Other Optional Ingredients

The compositions herein may further comprise conventional carpet cleaning ingredients. Preferably, the compositions herein may further comprise a number of additional compounds such as volatile organic compounds, surfactants, N-vinyl polymers, stabilising agents, chelating agents, builder systems, radical scavengers, perfumes, dyes, suds suppressing agents, enzymes, photobleaching agents, bleach activators and other minors.

Volatile Organic Compounds

As an optional but highly preferred ingredient the compositions according to the present invention may comprise a volatile organic compound (VOC) or a mixture thereof.

Typically, the compositions herein may comprise up to 90%, preferably from 0.1% to 20%, more preferably from 0.5% to 10% and most preferably from 1% to 5% by weight of the total composition of a volatile organic compound or a mixture thereof.

Suitable volatile organic compounds for use herein include aliphatic and/or aromatic alcohol, glycol ethers and/or derivatives thereof, polyol and mixtures thereof.

Suitable aromatic alcohols to be used herein are according to the formula $R_1$—OH wherein $R_1$ is an alkyl substituted or non-alkyl substituted aryl group of from 1 to 20 carbon atoms, preferably from 2 to 15 and more preferably from 2 to 10. A suitable aromatic alcohol to be used herein is benzyl alcohol.

Suitable aliphatic alcohols to be used herein are according to the formula $R_2$—OH wherein $R_2$ is a linear or branched saturated or unsaturated hydrocarbon chain of from 1 to 20 carbon atoms, preferably from 1 to 10 and more preferably from 2 to 6. Highly preferred herein are aliphatic alcohols with 2 to 4 carbon atoms and most preferably 4 carbon atoms, or mixtures thereof. Suitable aliphatic alcohols to be used herein include linear alcohol like 2-octanol, decanol, isopropyl alcohol, propyl alcohol, ethanol and/or methanol. Highly preferred herein are ethanol, isopropyl alcohol or a mixture thereof. Ethanol may be commercially available from Eridania Italia under its chemical name.

Isopropanol may be commercially available from Merck/BDH Italia under its chemical name.

Suitable glycol ethers and/or derivatives thereof to be used herein include monoglycol ethers and/or derivatives thereof, polyglycol ethers and/or derivatives thereof and mixtures thereof.

Suitable monoglycol ethers and derivatives thereof to be used herein include n-buthoxypropanol (n-BP). water-soluble CELLOSOLVE®) solvents or mixtures thereof. Preferred Cellosolve® solvents include propoxy ethyl acetate salt (i.e., Propyl Cellosolve acetate salt®), ethanol-2-butoxy phosphate salt (i.e., Butyl Cellosolve phosphate salt®), 2-(Hexyloxy)ethanol (i.e., 2-hexyl Cellosolve®), 2-ethoxy ethanol (i.e., 2-ethyl Cellosolve®), 2-butoxyethanol (i.e., 2-buthyl Cellosolve®) or mixtures thereof.

Suitable polyglycol ethers and derivatives thereof to be used herein include n-butoxypropoxypropanol (n-BPP), butyl triglycol ether (BTGE). butyl diglycol ether (BDGE), water-soluble CARBITOL® solvents or mixtures thereof.

Preferred water-soluble CARBITOL® solvents are compounds of the 2-(2-alkoxyethoxy)ethanol class, 2-(2-alkoxyethoxy)propanol class and/or 2-(2-alkoxyethoxy) butanol class wherein the alkoxy group is derived from ethyl, propyl or butyl. A preferred water-soluble carbitol is 2-(2-butoxyethoxy)ethanol also known as butyl carbitol®.

Preferred glycol ethers and/or derivatives thereof are 2-ethoxyethanol, 2-butoxyethanol, n-butoxypropoxypropanol, butyl carbitol® or mixtures thereof.

Suitable polyol solvents to be used herein are the polyols having at least 2 hydroxyl groups (—OH) like diols. Suitable diols to be used herein include 2-ethyl-1,3-hexanediol, 2.2, 4-trimethyl-1,3-pentanediol, methyl-2,4 pentanediol or mixture thereof.

The volatile organic compounds. when present, further contribute to the excellent overall cleaning performance of the present invention. Additionally, their addition in the compositions herein also enhances the sanitising properties of the compositions.

Surfactants

Preferred compositions according to the present invention typically comprise a surfactant or a mixture thereof.

Typically, the compositions herein may comprise up to 50%, preferably from 0.1% to 20%, more preferably from 0.5% to 10% and most preferably from 1% to 5% by weight of the total composition of a surfactant.

Such surfactants may be selected from those well known in the art including anionic, nonionic, zwitterionic, amphoteric and cationic surfactants and mixtures thereof.

Particularly suitable surfactants to be used herein are anionic surfactants. Said anionic surfactants are preferred herein as they further contribute to the outstanding stain removal performance of the compositions of the present invention on various types of stains. Moreover they do not stick on carpet, thereby reducing resoiling.

Suitable anionic surfactants include sarcosinate surfactants, alkyl sulfate surfactants, alkyl sulphonate surfactants, alkyl glycerol sulfate surfactants and alkyl glycerol sulphonate surfactants.

Suitable sarcosinate surfactants to be used herein include acyl sarcosinate or mixtures thereof, in its acid and/or salt form, preferably long chain acyl sarcosinates having the following formula:

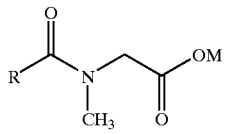

wherein M is hydrogen or a cationic moiety and wherein R is an alkyl group of from 11 to 15 carbon atoms, preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, particularly preferred long chain acyl sarcosinates to be used herein include $C_{12}$ acyl sarcosinate, i.e., an acyl sarcosinate according to the above formula wherein M is hydrogen and R is an alkyl group of 11 carbon atom, sodium N-lauroyl sarcosinate, i.e., an acyl sarcosinate according to the above formula wherein M is sodium and R is an alkyl group of 11 carbon atom, and $C_{14}$ acyl sarcosinate (i.e., an acyl sarcosinate according to the above formula wherein M is hydrogen and R is an alkyl group of 13 carbon atoms)., sodium N-lauroyl sarcosinate is commercially available, for example, as Hamposyl L-30® supplied by Hampshire or Crodasinic LS30® supplied by Croda. $C_{14}$ acyl sarcosinate is commercially available. for example, as Hamposyl M-30® supplied by Hampshire or Crodasinic MS30® supplied by Croda.

Suitable alkyl sulphonates for use herein include water-soluble salts or acids of the formula $RSO_3M$ wherein R is a $C_6$–$C_{20}$ linear or branched, saturated or unsaturated alkyl group, preferably a $C_8$–$C_{18}$ alkyl group and more preferably a $C_{10}$–$C_{16}$ alkyl group, and M is H or a cation, e.g. an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine. diethylamine, triethylamine, and mixtures thereof, and the like).

An example of a $C_{14}$–$C_{16}$ alkyl sulphonate is Hostapur ® SAS available from Hoechst.

Suitable alkyl sulphate surfactants for use herein are according to the formula $R_1SO_4M$ wherein $R_1$ represents a hydrocarbon group selected from the group consisting of straight or branched alkyl radicals containing from 6 to 20, preferably 8 to 18, more preferably 10 to 16, carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-,dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

By "linear alkyl sulphate or sulphonate" it is meant herein a non-substituted alkyl sulphate or sulphonate wherein the alkyl chain comprises from 6 to 20 carbon atoms, preferably from 8 to 18 carbon atoms. and more preferably from 10 to 16 carbon atoms, and wherein this alkyl chain is sulphated or sulphonated at one terminus.

By "branched sulphonate or sulphate", it is meant herein an alkyl chain having from 6 to 20 total carbon atoms, preferably from 8 to 18 total carbon atoms. and more preferably from 10 to 16 total carbon atoms, wherein the main alkyl chain is substituted by at least another alkyl chain, and wherein the alkyl chain is sulphated or sulphonated at one terminus.

Particularly preferred branched alkyl sulphates to be used herein are those containing from 10 to 14 total carbon atoms like Isalchem 123 AS®. Isalchem 123 AS® commercially available from Enichem is a $C_{12-13}$ surfactant which is 94% branched. This material can be described as $CH_3$—$(CH_2)_m$—$CH(CH_2OSO_3Na)$—$(CH_2)_n$—$CH_3$ where n+m=8–9. Also preferred alkyl sulphates are the alkyl sulphates where the alkyl chain comprises a total of 12 carbon atoms, i.e., sodium 2-butyl octyl sulphate. Such alkyl sulphate is commercially available from Condea under the trade name Isofol® 12S. Particularly suitable liner alkyl sulphonates include C12–C16 paraffin sulphonate like Hostapur ® SAS commercially available from Hoechst.

Suitable nonionic surfactants include amine oxide surfactants. Suitable amine oxide surfactants are according to the formula $R_1$ $R_2R_3NO$, wherein each of $R_1$, $R_2$ and $R_3$ is independently a saturated substituted or unsubstituted, linear or branched alkyl groups of from 1 to 30 carbon atoms, preferably of from 1 to 20 carbon atoms, and mixtures thereof.

Particularly preferred amine oxide surfactants to be used according to the present invention are amine oxide surfactants having the following formula $R_1R_2R_3NO$ wherein $R_1$ is a saturated linear or branched alkyl group of from 1 to 30 carbon atoms, preferably of from 6 to 20 carbon atoms, more preferably of from 6 to 16 carbon atoms, and wherein $R_2$ and $R_3$ are independently substituted or unsubstituted, linear or branched alkyl groups of from 1 to 4 carbon atoms, preferably of from 1 to 3 carbon atoms, and more preferably are methyl groups. Preferred amine oxide surfactants used herein are pure-cut amine oxide surfactants, i.e. a pure single amine oxide surfactant, e.g. $C_8$ N,N-dimethyl amine oxide, as opposed to mixtures of amine oxide surfactants of different chain lengths Suitable amine oxide surfactants for use herein are for instance pure cut $C_8$ amine oxide, pure cut $C_{10}$ amine oxide, pure cut $C_{14}$ amine oxide, natural blend $C_8$–$C_{10}$ amine oxides as well as natural blend $C_{12}$–$C_{16}$ amine oxides. Such amine oxide surfactants may be commercially available from Hoechst or Stephan.

Suitable nonionic surfactants for use herein also include any ethoxylated $C_6$–$C_{24}$ fatty alcohol nonionic surfactant, alkyl propoxylates and mixtures thereof, fatty acid $C_6$–$C_{24}$ alkanolamides, $C_6$–$C_{20}$ polyethylglycol ethers, polyethylene glycol with molecular weight 1000 to 80000 and glucose amides, alkyl pyrrolidones.

Suitable cationic surfactants for use herein include quaternary ammonium compounds of the formula $R_1R_2R_3R_4N$+ where $R_1$,$R_2$ and $R_3$ are methyl groups, and $R_4$ is a $C_{12-15}$ alkyl group, or where R1 is an ethyl or hydroxy ethyl group, $R_2$ and $R_3$ are methyl groups and $R_4$ is a $C_{12-15}$ alkyl group.

Suitable zwitterionic surfactants are zwitterionic betaine surfactants. Suitable zwitterionic betaine surfactants for use herein contain both a cationic hydrophilic group, i.e., a quaternary ammonium group, and anionic hydrophilic group on the same molecule at a relatively wide range of pH's. The typical anionic hydrophilic groups are carboxylates and sulphonates, although other groups like sulfates, phosphonates, and the like can be used. A generic formula for the zwitterionic betaine surfactant to be used herein is $$R_1—N+(R_2)(R_3)R_4X—$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ sulphonate group, $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group, which is a carboxylate or sulphonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24, preferably from 8 to 18, and more preferably from 10 to 16 carbon atoms. These simple alkyl groups are preferred for cost and stability reasons. However, the hydrophobic group $R_1$ can also be an amido radical of the formula $R_a$—C(O)—NH—$(C(R_b)_2)$m, wherein $R_a$ is an aliphatic or aromatic, saturated or unsaturated, substituted or unsubstituted hydrocarbon chain, preferably an alkyl group containing from 8 up to 20, preferably up to 18, more preferably up to 16 carbon atoms, $R_b$ is selected from the group consisting of hydrogen and hydroxy groups, and m is from 1 to 4, preferably from 2 to 3, more preferably 3, with no more than one hydroxy group in any $(C(R_b)_2)$ moiety.

Preferred $R_2$ is hydrogen, or a $C_1$–$C_3$ alkyl and more preferably methyl. Preferred R3 is $C_1$–$C_4$ sulphonate group, or a $C_1$–$C_3$ alkyl and more preferably methyl. Preferred $R_4$ is $(CH2)_n$ wherein n is an integer from 1 to 10, preferably from 1 to 6, more preferably is from 1 to 3.

Some common examples of betaine/sulphobetaine are described in U.S. Pat. Nos. 2,082,275, 2,702,279 and 2,255,082, incorporated herein by reference.

Examples of particularly suitable alkyldimethyl betaines include coconut-dimethyl betaine, lauryl dimethyl betaine, decyl dimethyl betaine, 2-(N-decyl-N, N-dimethylammonia)acetate, 2-(N-coco N, N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

Examples of amidobetaines include cocoamidoethylbetaine, cocoamidopropyl betaine or $C_{10}$–$C_{14}$ fatty acylamidopropylene(hydropropylene) sulfobetaine. For example $C_{10}$–$C_{14}$ fatty acylamidopropylene(hydropropylene)sulfobetaine is commercially available from Sherex Company under the trade name "Varion CAS® sulfobetaine".

A further example of betaine is Lauryl-imminodipropionate commercially available from Rhone-Poulenc under the trade name Mirataine H2C-HA®.

A preferred surfactant for use herein is an anionic surfactant or a zwitterionic surfactant or a mixture thereof, a more preferred surfactant is a sarcosinate surfactant, an alkyl sulphonate surfactant, an alkyl sulphate surfactant, an alkyl glycerol sulphate surfactant, an alkyl glycerol sulphonate surfactant or a zwitterionic betaine surfactant and mixtures thereof, an even more preferred surfactant is a sarcosinate surfactant, an alkyl sulphonate surfactant, an alkyl sulphate surfactant, or a zwitterionic betaine surfactant and mixtures thereof, and the most preferred surfactant herein is an alkyl sarcosinate surfactant.

It has been found that polyamine N-oxide polymers as described herein can increase the activity of surfactants, preferably anionic surfactants and/or zwitterionic surfactants, most preferably sarcosinate surfactants, when present. Said increase in activity is thought to be due to an interaction of the polyamine N-oxide polymer and a surfactant, preferably an anionic surfactant and/or a zwitterionic surfactant, most preferably a sarcosinate surfactant. Said increase in activity further contributes to the overall cleaning performance of the compositions herein.

N-vinyl Polymer

The compositions of the present invention may further comprise an N-vinyl polymer.

The liquid compositions may comprise from 0.01% to 10%, preferably from 0.01% to 5%, and more preferably from 0.05% to 2% by weight of the total composition of an N-vinyl polymer.

Suitable N-vinyl polymers include polyvinyl pyrrolidone polymers, co-polymers of N-vinylpyrrolidone and N-vinylimidazole, co-polymers of N-vinylpyrrolidone and acrylic acid, and mixtures thereof.

Suitable co-polymers of N-vinylpyrrolidone and N-vinylimidazole polymers (referred to as a class as "PVPVI") are according to the formula:

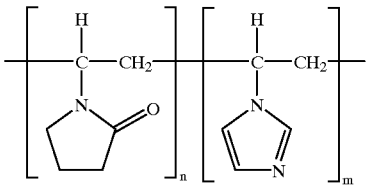

in which n is between 50 and 500 and preferably between 80 and 200 and m is between 50 and 500 and preferably between 80 and 200.

Preferably the PVPVI has an average molecular weight range from 1,000 to 100,000, more preferably from 5,000 to 100,000, and most preferably from 5,000 to 20,000. (The average molecular weight range is determined by light scattering as described in Barth. et al., *Chemical Analysis*, Vol 113. "Modern Methods of Polymer Characterization", the disclosures of which are incorporated herein by reference.)

The PVPVI co-polymers typically have a molar ratio of N-vinylimidazole to N-vinylpyrrolidone from 1:1 to 0.2:1, more preferably from 0.8:1 to 0.3:1, most preferably from 0.6:1 to 0.4:1. These co-polymers can be either linear or branched.

Suitable co-polymers of N-vinylpyrrolidone and N-vinylimidazole are commercially available from BASF, under the trade name of Sokalan® PG55.

Suitable polyvinylpyrrolidone ("PVP") for use herein are homopolymers of N-vinylpyrrolidone having the following repeating monomer:

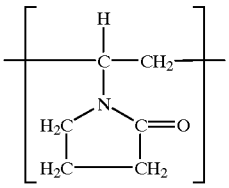

Preferred vinylpyrrolidone homopolymers for use herein have an average molecular weight of from 1,000 to 100,000, preferably from 5,000 to 100,000, and more preferably from 5.000 to 20,000.

Suitable vinylpyrrolidone homopolymers are commercially available from BASF under the trade names Luviskol® K15 (viscosity molecular weight of 10,000), Luviskol® K25 (viscosity molecular weight of 24.000), Luviskol® K30 (viscosity molecular weight of 40,000), and other vinylpyrrolidone homopolymers known to persons skilled in the detergent field (see for example EP-A-262,897 and EP-A-256,696).

Suitable co-polymers of N-vinylpyrrolidone and acrylic acid (referred to as a class as "PV/AA") are according to the formula:

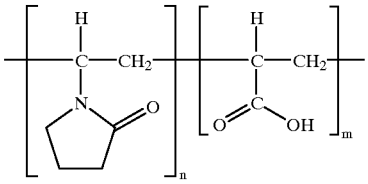

in which n is between 50 and 1000 and preferably between 100 and 200 and m is between 150 and 3000 and preferably between 300 and 600.

Preferably the PV/AA have an average molecular weight range from 1,000 to 100,000, more preferably from 5,000 to 100,000, and most preferably from 5,000 to 25,000.

Suitable co-polymers of N-vinylpyrrolidone and acrylic acid are commercially available from BASF under the trade name Sokalan® PG 310.

Preferred N-vinyl polymers are polyvinyl pyrrolidone polymers, co-polymers of N-vinylpyrrolidone and N-vinylimidazole, co-polymers of N-vinylpyrrolidone and acrylic acid, and mixtures thereof, even more preferred are polyvinyl pyrrolidone polymers.

The N-vinyl polymers, when present. further contribute to the excellent overall cleaning performance of the present invention. Additionally, their addition in the compositions herein also enhances the anti-resoiling properties of the compositions.

Stabilizing Agents

The compositions of the present invention may further comprise a stabilizing agent selected from the group consisting of hydroxy pyridine N-oxides or derivatives thereof and mixtures thereof.

Suitable hydroxy pyridine N-oxides or derivatives thereof are according to the following formula:

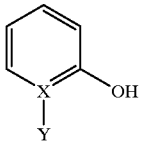

wherein X is nitrogen, Y is one of the following groups oxygen. —CHO, —OH, —$(CH_2)$n-COOH, wherein n is an integer of from 0 to 20, preferably of from 0 to 10 and more preferably is 0, and wherein Y is preferably oxygen. Accordingly particularly preferred hydroxy pyridine N-oxides or derivatives thereof to be used herein is 2-hydroxy pyridine N-oxide.

Hydroxy pyridine N-oxides or derivatives thereof may be commercially available from Sigma.

Typically, the compositions herein may comprise up to 2%, preferably from 0.001% to 1% and more preferably from 0.001% to 0.5% by weight of the total composition of a hydroxy pyridine N-oxide or derivatives thereof or mixtures thereof.

Chelating Agents

The compositions of the present invention may further comprise a chelating agent.

Suitable chelating agents are those known to those skilled in the art. Particularly suitable chelating agents include for examples phosphonate chelating agents, polyfunctionally-substituted aromatic chelating agents, amino carboxylate chelating agents, other chelating agents like ethylene diamine N,N'- disuccinic acid and mixtures thereof.

Typically, the compositions herein may comprise up to 4%, preferably from 0.001% to 1%, and more preferably from 0.001% to 0.5% by weight of the total composition of a chelating agent.

Suitable phosphonate chelating agents to be used herein may include ethydronic acid, alkali metal ethane 1-hydroxy diphosphonates as well as amino phosphonate compounds, including amino alkylene poly (alkylene phosphonate), alkali metal ethane 1-hydroxy diphosphonates, nitrilo trimethylene phosphonates, ethylene diamine tetra methylene phosphonates, and diethylene triamine penta methylene phosphonates. The phosphonate compounds may be present either in their acid form or as salts of different cations on some or all of their acid functionalities. Preferred phosphonate chelating agents to be used herein are diethylene triamine penta methylene phosphonates (DETPMP). Such phosphonate chelating agents are commercially available from Monsanto under the trade name DEQUEST®.

Polyfunctionally-substituted aromatic chelating agents may also be useful in the compositions herein. See U.S. Pat. No. 3.812.044. issued May 21, 1974, to Connor et al. Preferred compounds of this type in acid form are dihydroxydisulfobenzenes such as 1,2-dihydroxy -3,5-disulfobenzene. A preferred biodegradable chelating agent for use herein is ethylene diamine N,N'- disuccinic acid, or alkali metal, or alkaline earth, ammonium or substitutes ammonium salts thereof or mixtures thereof. Ethylenediamine N,N'- disuccinic acids, especially the (S,S) isomer, have been extensively described in U.S. Pat. No. 4,704,233, Nov. 3, 1987. to Hartman and Perkins. Ethylenediamine N,N'- disuccinic acid is, for instance, commercially available under the tradename ssEDDS® from Palmer Research Laboratories.

Suitable amino carboxylate chelating agents to be used herein include ethylene diamine tetra acetates, diethylene triamine pentaacetates, diethylene triamine pentaacetate (DTPA), N-hydroxyethylethylenediamine triacetates, nitrilotri-acetates, ethylenedi amine tetrapropionates, triethylenetetraam inehexa-acetates, ethanoldiglycines, propylene diamine tetracetic acid (PDTA) and methyl glycine di-acetic acid (MGDA), both in their acid form, or in their alkali metal, ammonium, and substituted ammonium salt forms. A particularly suitable amino carboxylate to be used herein is diethylene triamine penta acetic acid (DTPA).

Other suitable chelating agents to be used nerein include salicylic acid or derivatives thereof, or mixtures thereof according to the following formula:

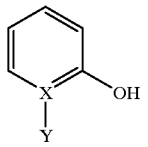

wherein X is carbon. Y is one of the following groups —CHO, —OH, —(CH2)n—COOH, and preferably is —(CH2)n—COOH, and wherein n is an integer of from 0 to 20, preferably of from 0 to 10 and more preferably is 0. Salicylic acid and derivatives thereof may be used herein either in their acid form or in their salts form as for example sodium salts.

Salicylic acid is particularly preferred herein and may be commercially available from Rhone Poulenc.

Bleach Activators

In an embodiment of the present invention where the compositions herein comprise a peroxygen bleach, preferably hydrogen peroxide, said compositions may further comprise a bleach activator, as an optional ingredient.

By "bleach activator", it is meant herein a compound which reacts with the peroxygen bleach, preferably hydrogen peroxide, to form a peracid. The peracid thus formed constitutes the activated bleach.

Suitable bleach activators to be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4 818 425 and nonylamide of peroxyadipic acid as described for instance in U.S. Pat. No. 4 259 201 and n-nonanoyloxybenzenesulphonate (NOBS). Also suitable are N-acyl caprolactam selected from the group consisting of substituted or unsubstituted benzoyl caprolactam. octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmentally friendly as it eventually degrades into citric acid and alcohol. Furthermore, acetyl triethyl citrate has a good hydrolytical stability in the composition upon storage and it is an efficient bleach activator.

The compositions according to the present invention may comprise up to 30%, preferably from 1% to 20%, and more preferably from 2% to 10% by weight of the total composition of a bleach activator.

Builders

The compositions according to the present invention may further comprise a builder system. Any conventional builder system known in the art is suitable for use herein. Suitable builders for use herein include derivatives of succinic acid of the formula R-CH(COOH)$CH_2$(COOH) wherein R is $C_{10-20}$ alkyl or alkenyl, preferably $C_{12-16}$ alkyl or alkenyl, or wherein R can be substituted with hydroxyl, sulpho sulphoxyl or sulphone substituents. Specific examples include lauryl succinate, myristyl succinate, palmityl succinate, 2-dodecenylsuccinate, 2-tetradecenyl succinate. Succinate builders are preferably used in the form of their water-soluble salts, including sodium, potassium, ammonium and alkanolammonium salts.

Other suitable builders are oxodisuccinates and mixtures of tartrate monosuccinic and tartrate disuccinic acid such as described in U.S. Pat. No. 4,663,071.

Further suitable builders for use herein are fatty acid builders including saturated or unsaturated $C_{10-18}$ fatty acids, as well as the corresponding soaps. Preferred saturated species have from 12 to 16 carbon atoms in the alkyl chain. The preferred unsaturated fatty acid is oleic acid.

The compositions herein may comprise up to 10%, preferably from 1% to 7% by weight of the total composition of a builder system.

Radical Scavenqers

The compositions herein may comprise a radical scavenger as another optional ingredient. Suitable radical scavengers for use herein include the well-known substituted mono and di hydroxy benzenes and derivatives thereof, alkyl- and aryl carboxylates and mixtures thereof. Preferred radical scavengers for use herein include di-tert-butyl hydroxy toluene (BHT), p-hydroxy-toluene, hydroquinone (HQ), di-tert-butyl hydroquinone (DTBHQ), mono-tert-butyl hydroquinone (MTBHQ), tert-butyl-hydroxy anysole (BHA), p-hydroxy-anysol, benzoic acid, 2,5-dihydroxy benzoic acid, 2.5-dihydroxyterephtalic acid, toluic acid, catechol, t-butyl catechol, 4-allyl-catechol, 4-acetyl catechol, 2-methoxy-phenol, 2-ethoxy-phenol, 2-methoxy4-(2-propenyl)phenol, 3,4-dihydroxy benzaldehyde, 2,3-dihydroxy benzaldehyde, benzylamine, 1,1,3-tris(2-methyl4-hydroxy-5-t-butylphenyl) butane, tert-butyl-hydroxy-anyline, p-hydroxy anyline as well as n-propyl-gallate. Highly preferred for use herein is di-tert-butyl hydroxy toluene, which is for example commercially available from SHELL under the trade name IONOL CP® and/or tert-butyl-hydroxy anysole and/or propyl gallate. These radical scavengers further contribute to the stability of the compositions herein.

Typically, the compositions according to the present invention may comprise up to 5%, preferably from 0.002% to 1.5% by weight and more preferably from 0.002% to 0.5% by weight of the total composition of a radical scavenger.

EXAMPLES

The following examples will illustrate the present invention. The compositions are made by combining the listed ingredients in the listed proportions (weight % unless otherwise specified).

| Compositions (weight %) | I | II | III | IV | V | VI |
|---|---|---|---|---|---|---|
| Hydrogen peroxide | 4.0 | 4.0 | 5.0 | 6.0 | — | — |
| PVNO | 0.5 | 0.4 | 0.4 | 0.4 | 0.4 | 0.5 |
| PVPVI | — | 0.2 | — | — | 0.1 | — |
| PV/AA | — | — | 0.2 | — | 0.1 | — |
| PVP | — | — | — | 0.2 | 0.1 | — |
| Water and minors | Balance | Balance | Balance | Balance | Balance | Balance |
| up to pH | 6 | 6.5 | 5 | 4 | 6 | 5 |

| Compositions (weight %) | VII | VIII | IX | X | XI | XII |
|---|---|---|---|---|---|---|
| Hydrogen peroxide | 4.0 | 4.0 | — | 6.0 | 4.0 | 4.0 |
| PVNO | 0.5 | 0.4 | 0.2 | 0.5 | 1.0 | 2.0 |
| PVPVI | — | — | — | 0.5 | — | — |
| PV/AA | — | — | 0.3 | — | — | — |
| PVP | — | — | — | — | 0.1 | — |
| Ethanol | 3.0 | 3.0 | 3.0 | 3.0 | 3.0 | 3.0 |
| PA | — | 0.1 | 0.2 | 0.1 | — | 0.1 |
| Sarcosinate | 3.0 | 3.0 | 3.0 | — | 2.5 | 3.0 |
| BHT | 0.01 | 0.01 | 0.02 | 0.01 | — | 0.01 |
| AMCP | — | — | — | — | 0.5 | — |
| Chelant* | 0.2 | 0.2 | 0.2 | 0.2 | 0.3 | 0.3 |
| Na CnAS | — | — | — | 3.0 | 0.5 | — |
| Salicylic Acid | 0.5 | 0.5 | 0.5 | 0.5 | — | 0.5 |
| Propyl Gallate | — | — | — | — | 1.0 | — |
| NaOH | 0.16 | 0.16 | 0.16 | 0.16 | 0.06 | 0.26 |
| Water and minors | Balance | Balance | Balance | Balance | Balance | Balance |
| up to pH | 6 | 6 | 6 | 6 | 3.5 | 8 |

| Compositions (weight %) | XIII | XIV | XV | XVI | XVII | XVIII |
|---|---|---|---|---|---|---|
| Hydrogen peroxide | 4.0 | 5.0 | 4.0 | 5.5 | 6.0 | — |
| PVNO | 0.25 | 2.0 | 0.25 | 0.5 | 0.4 | 0.1 |
| PVPVI | — | 0.4 | 0.25 | — | 0.1 | — |
| PV/AA | 0.25 | 0.1 | — | — | 0.2 | 0.4 |
| PVP | — | — | 0.25 | — | 02 | 0.1 |
| Ethanol | 3.0 | 2.0 | 3.0 | 2.5 | 3.0 | 2.0 |
| PA | 0.1 | — | — | — | — | 0.2 |
| AMCP | — | 0.1 | — | — | — | — |
| Chelant* | 0.2 | 0.3 | 0.25 | 0.2 | 0.2 | 0.2 |
| Sarcosinate | 3.0 | 2.0 | 2.5 | 3.0 | 3.0 | 3.0 |
| Salicylic Acid | 0.5 | 0.25 | 0.4 | — | — | 0.5 |
| Propyl Gallate | — | 0.2 | — | 0.5 | 1.0 | — |
| BHT | 0.01 | — | 0.1 | — | — | 0.01 |
| Benzyl alcohol | — | 1.0 | — | 0.5 | — | 1.0 |
| Isopropyl alcohol | 1.0 | — | — | — | — | 0.5 |
| NaOH | 0.16 | 0.16 | 0.16 | 0.16 | 0.16 | 0.001 |
| Water and minors | Balance | Balance | Balance | Balance | Balance | Balance |
| up to pH | 6 | 6.5 | 5 | 6.0 | 6 | 3.5 |

PVP is Poly Vinyl Pyrrolidone

PVNO is Poly(4-Vinylpyridine-N-Oxide) (Mw 20,000) commercially available from Reilly.

PV/AA is N-vinylpyrrolidone and Acrylic Acid copolymer commercially available under the trade name Sokalan® PG 310.

PVPVI is N-vinylpyrrolidone and N-vinylimidazole co-polymer commercially available under the trade name Sokalan® PG55.

Sarcosinate is Sodium N-Lauroyl Sarcosinate commercially available from

Croda under the commercial name of Crodasinic® LS 30.

BHT is butylated hydroxy toluene.

AMCP is acrylicimaleic based copolymers commercially available under the trade name Sokalan CP5®.

Chelant* is a phosphonate chelant available under the trade name DEQUEST®

Na CnAS is sodium alkyl sulphate.

PA is an ethoxylated tetraethylenepentamine, average molecular weight 12,000.

The compositions exemplified above are preferably packaged in a container adapted to deliver a spray of droplets having a particle size distribution with a mean diameter D(v,0.9) of 200 to 400 microns, when measured with Malvern Mastersizer S LongBed ® referenced herein before. A suitable container used was an electrically driven sprayer.

The compositions in the examples above deliver excellent anti-resoiling properties as well as excellent cleaning performance on particulate soil, greasy/oily soil, and/or enzymatic soil as well as on other types of soils.

What is claimed is:

1. A process of cleaning a carpet with a liquid composition comprising an anti-resoiling agent, said process comprising the steps of applying an effective amount of said composition to the surface of the carpet to impart anti-resoiling properties to the carpet and leaving said composition to dry onto the carpet, wherein said anti-resoiling agent is polyvinyl pyridine-N-oxide.

* * * * *